US006663023B1

(12) United States Patent
Jou

(10) Patent No.: US 6,663,023 B1
(45) Date of Patent: Dec. 16, 2003

(54) MULTIPURPOSE UNIT AIR GUN-TOOL

(76) Inventor: Wuu-Cheau Jou, No. 487-6, Tsao Hu Road, Da Li City, Taichung Hsien (TW)

( * ) Notice: Subject to any disclaimer, the term of this patent is extended or adjusted under 35 U.S.C. 154(b) by 0 days.

(21) Appl. No.: 10/229,781

(22) Filed: Aug. 29, 2002

(51) Int. Cl.[7] ..... B05B 7/02

(52) U.S. Cl. ..... 239/526; 239/600

(58) Field of Search ..... 239/290, 390, 239/391, 397, 396, 525, 526, 590, 590.3, 600, DIG. 21, DIG. 22, 587.1, 587.2, 587.3, 587.4, 587.5, 587.6; 285/160, 260, 261, 264, 304

(56) References Cited

U.S. PATENT DOCUMENTS 3,811,622 A * 5/1974 Blatt ..... 239/526
5,626,123 A * 5/1997 Johnson et al. ..... 124/69
5,855,222 A * 1/1999 Jou ..... 137/223
6,505,784 B1 * 1/2003 Jou ..... 239/525

* cited by examiner

*Primary Examiner*—Lisa A. Douglas
(74) *Attorney, Agent, or Firm*—Charles E. Baxley

(57) ABSTRACT

The present air gun-tool relates to a multipurpose unit air gun-tool, taking the advantage of a combined snap securing adaptor, air gun-tool which can be changed with several special throttle components on a based common component into different functional air gun-tool for meeting the necessary of the working site and facilitating to carry so that the production cost is reduced.

5 Claims, 16 Drawing Sheets

MULTIPURPOSE UNIT AIR GUN-TOOL

BACKGROUND OF THE INVENTION

1. Field of the Invention

The present invention relates to a multipurpose unit air gun-tool, and more especially to a unit air gun that can be combined into different function air gun-tool rapidly and conveniently at will.

2. Description of Prior Art

In accordance with the conventional air gun-tools, such as spray guns, as shown in FIG. 15, inflating adaptors, dual spray guns for painting and cleaning shown in FIG. 16, pneumatic cocooning guns, pneumatic sandblasting gun, and so on, they are based on an air gun body 1 used for controlling turn-on or off the compressed air so that said compressed air passes through different function tool-head to get different effect and performance, but the most of them are designed into one piece for one function, although they are based on an similar air gun body individually designed with the same principle, and in the most time they have almost same high of use frequency, but they have not been integrated into one piece, therefore they have some existing shortcomings in practicing as follows:

1. Poor portability: as maintenance or installation, the users have to often carry several air gun-tools with them simultaneously, like an automotive mechanic often has to carry a blowing air gun for cleaning and an inflating air gun for inflating tires, an engine mechanic usually has to carry a blowing air gun for cleaning; a washing air gun for washing the inside and outside surface of engine; a mechanic always has to a blowing air gun, a sand-blasting gun for rusting removal, a pneumatic washing gun; a glass maintainer or a furrier should carry a blowing air gun and a pneumatic glue spray gun for cleaning and gluing processes, according to above description, every practice above-mentioned has to be equipped with more than two air gun-tools at least, simultaneously take apart or connection of the air pipe frequently for replacing said air gun-tools in working time, additionally said air gun-tools occupies big volume so as to inconveniently carry and use.
2. High cost: every air gun-tool is designed for a special function working as a special application tool to perform its single effect, although they have common components, like a component used for controlling the stream of compressed air cut in or out, but all independent special functional throttle components of pneumatic tools can not be integrated into built-up basic common component, so that the production cost is higher, so the price of all set of pneumatic tools is higher, the competitive capability of market is also relatively poorer.

OBJECTS AND SUMMARY OF THE INVENTION

It is therefore a main object of the present invention to provide a multipurpose unit air gun-tool, taking the advantage of a combined snap securing adaptor, said air gun-tool can be changed with several special throttle components on a based common component into different functional air gun-tool for meeting the necessary of the working site and facilitating to carry so that the production cost is reduced.

DETAILED DESCRIPTION OF PREFERRED EMBODIMENTS

Figure 1:
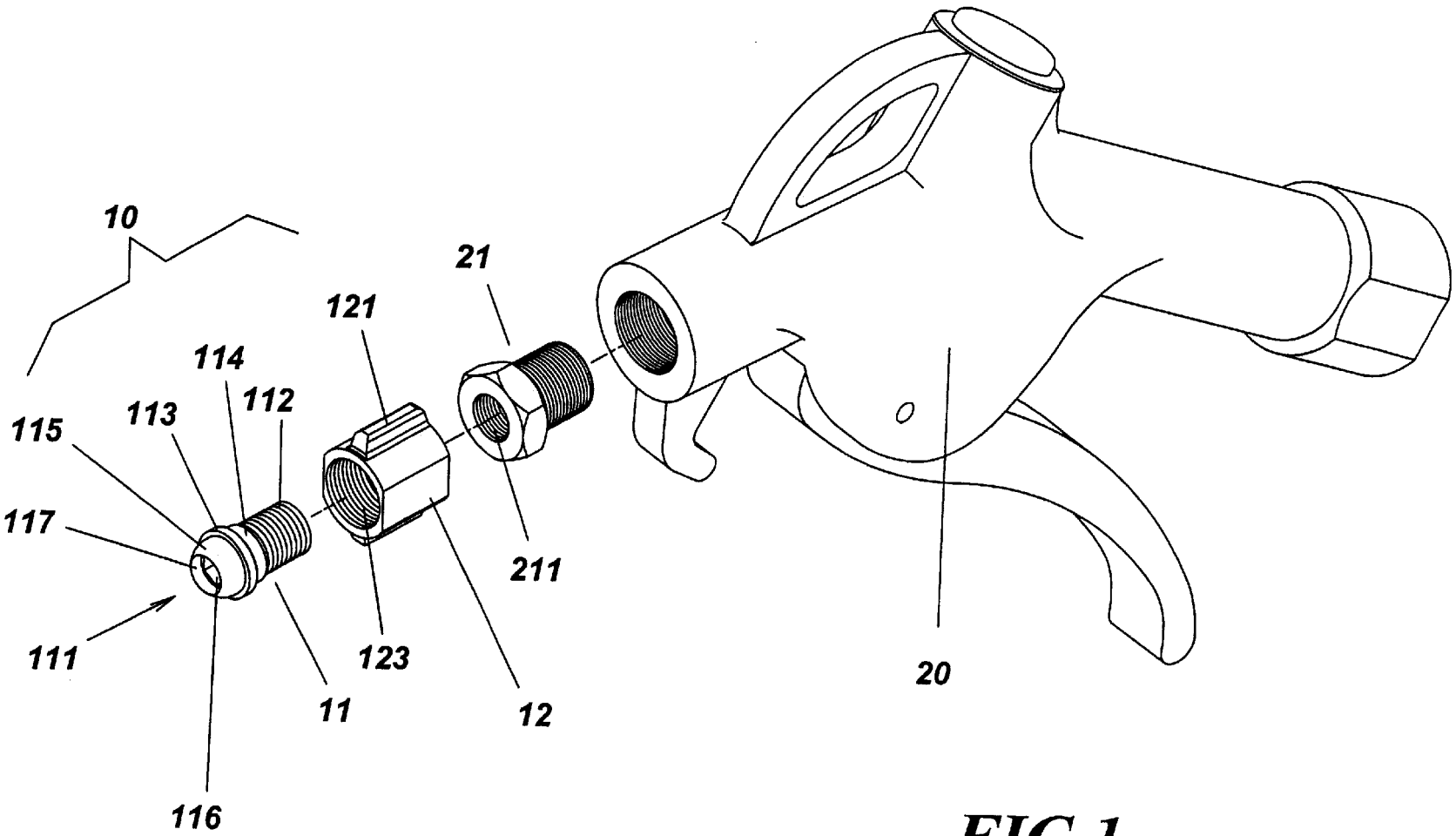
FIG. 1 is an exploded view showing the unit adaptor of the present invention.
Figure 2:
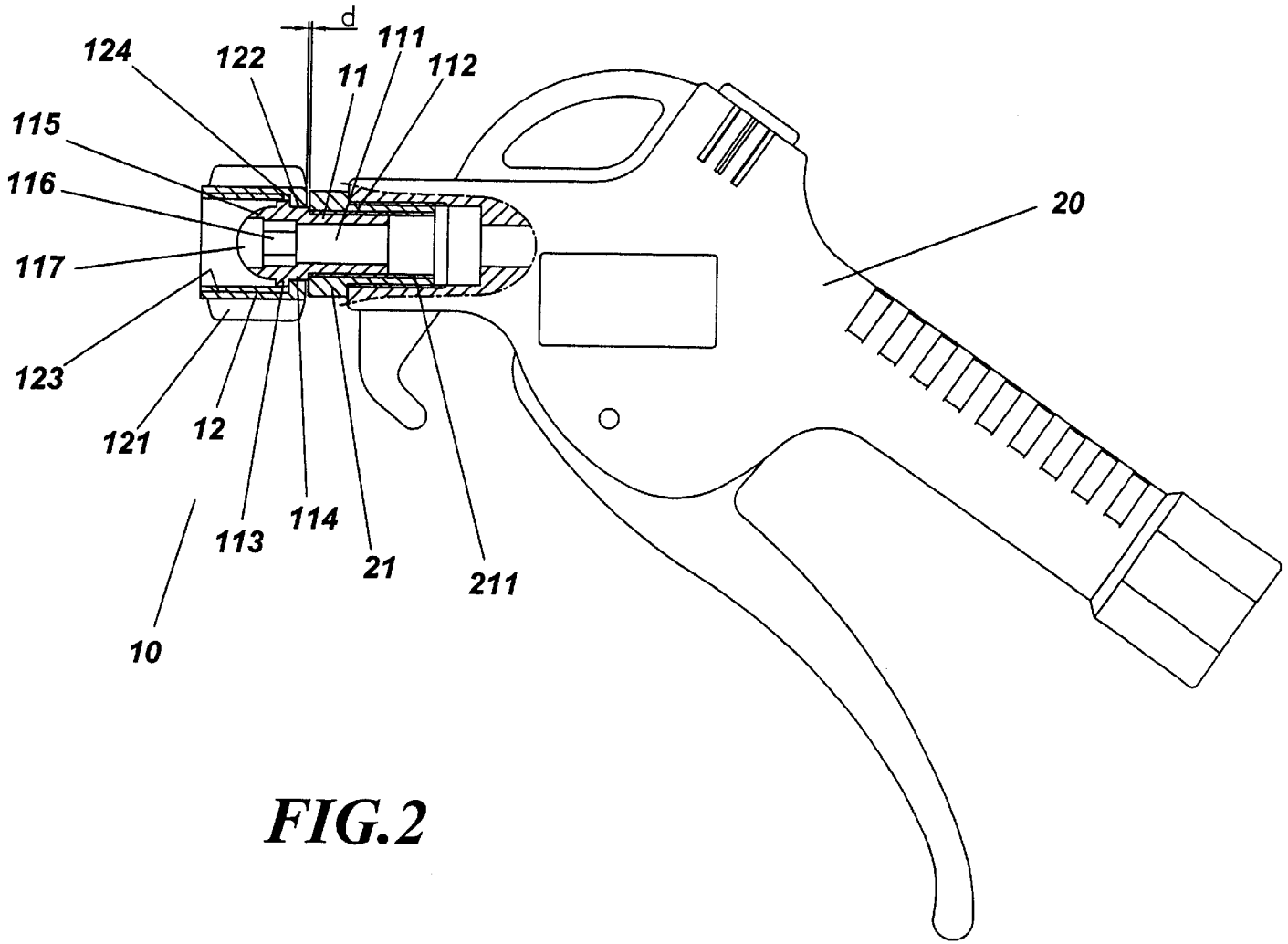
FIG. 2 is a sectional side view showing the combination state of said unit adaptor of the present invention.

Referring to FIG. 1 and FIG. 2, the present invention is comprised of a snap securing combined adaptor 10, in which one end is secured to a gun body 20, controlling compressed air to cut in or out, through a retaining bolt 21 with an inside through hole 211 at the outlet for securing said combined snap adaptor 10; wherein said combined snap adaptor 10 includes a sleeve bolt 11 having a through-hole 111 for passing through the stream of compressed air, and a flange 113 having a pivoting connection portion 114 at one side for connecting to a shuttle nut 12 in pivoting connection, on the another side of said flange 113 there is a ball connection portion 115, and a socket 116 is built on the tip end of said ball connection portion 115 at approaching the terminal end of said through-hole 111 for securing on by screwing a socket screw wrench gearing in it, and a guide hole 117 a little bit bigger than said socket 116 is built upon the outside of said socket 116 at the terminal end of said through-hole 111 for leading the flow of compressed air out smoothly; said sleeve bolt 11 holding said shuttle nut 12 freely is secured on said retaining bolt 21 with a threaded end 112; said shuttle nut 12 has at least one pair of ribs 121 built on the outside surface axially for grasping to turn rapidly, and a pivoting hole 122 built upon one end for putting on the pivoting connection portion 114 of said sleeve bolt 11 in pivoting connection state, and an internal threaded hole 123 built upon the another end of said shuttle nut 12 for securing on different function throttle component, so that, when said sleeve bolt 11 is secured on said retaining bolt 21 with said threaded end 112, a gap space d between the opposite terminal surfaces of said pivoting connection portion 114 and said retaining bolt 21 is left a bit more than the length of said pivoting hole 122 so that the shuttle nut 12 can be moved a bit freely; by touching against between the shoulder 124 of said pivoting hole 122 at the end of said internal threaded hole 123 with said flange 113 of said sleeve bolt 11, said shuttle bolt 12 is limited in the front end for sliding.

Figure 3:
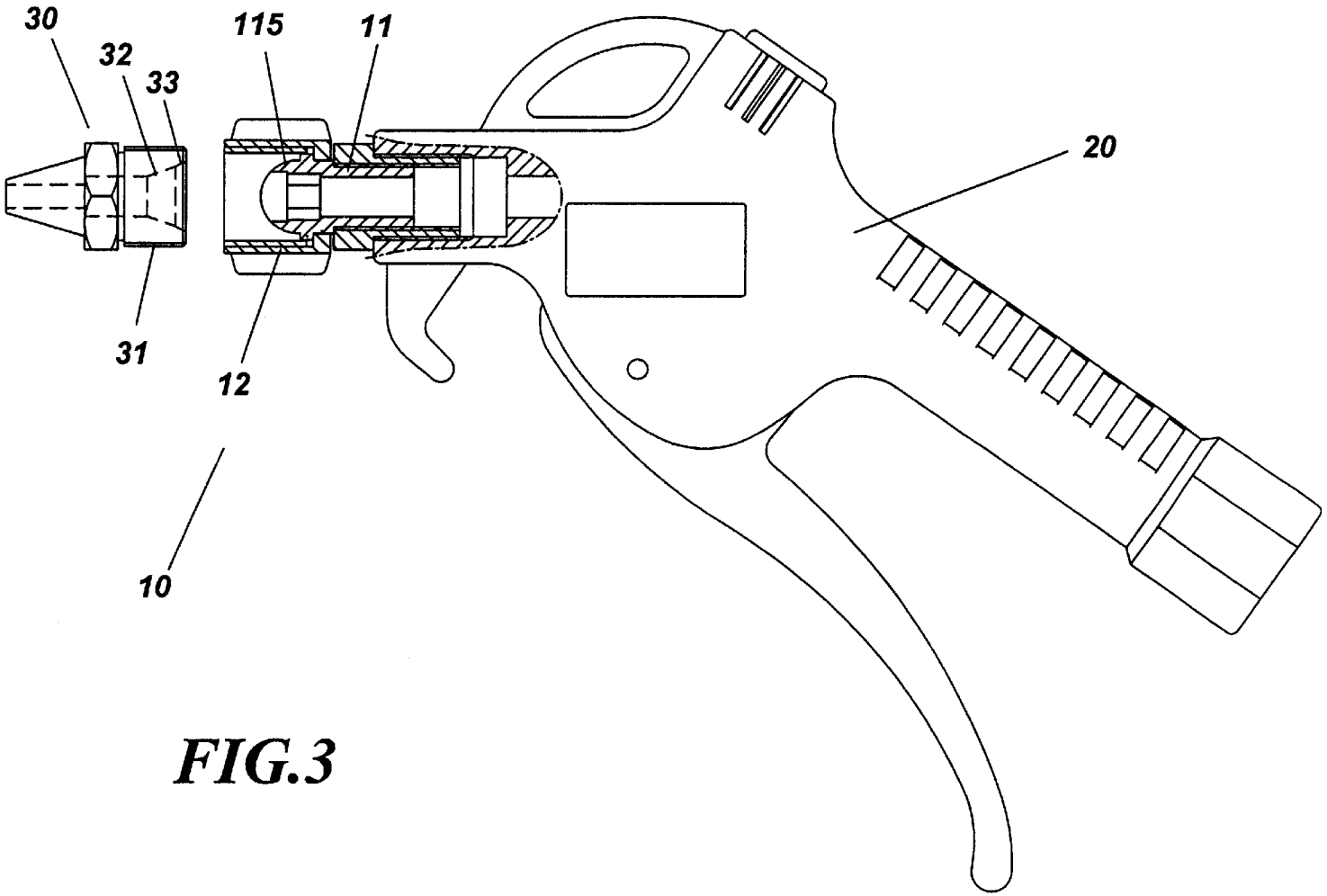
FIG. 3 is an exploded side view showing connecting with an air tool (short blow pistol) of the present invention.
Figure 4:
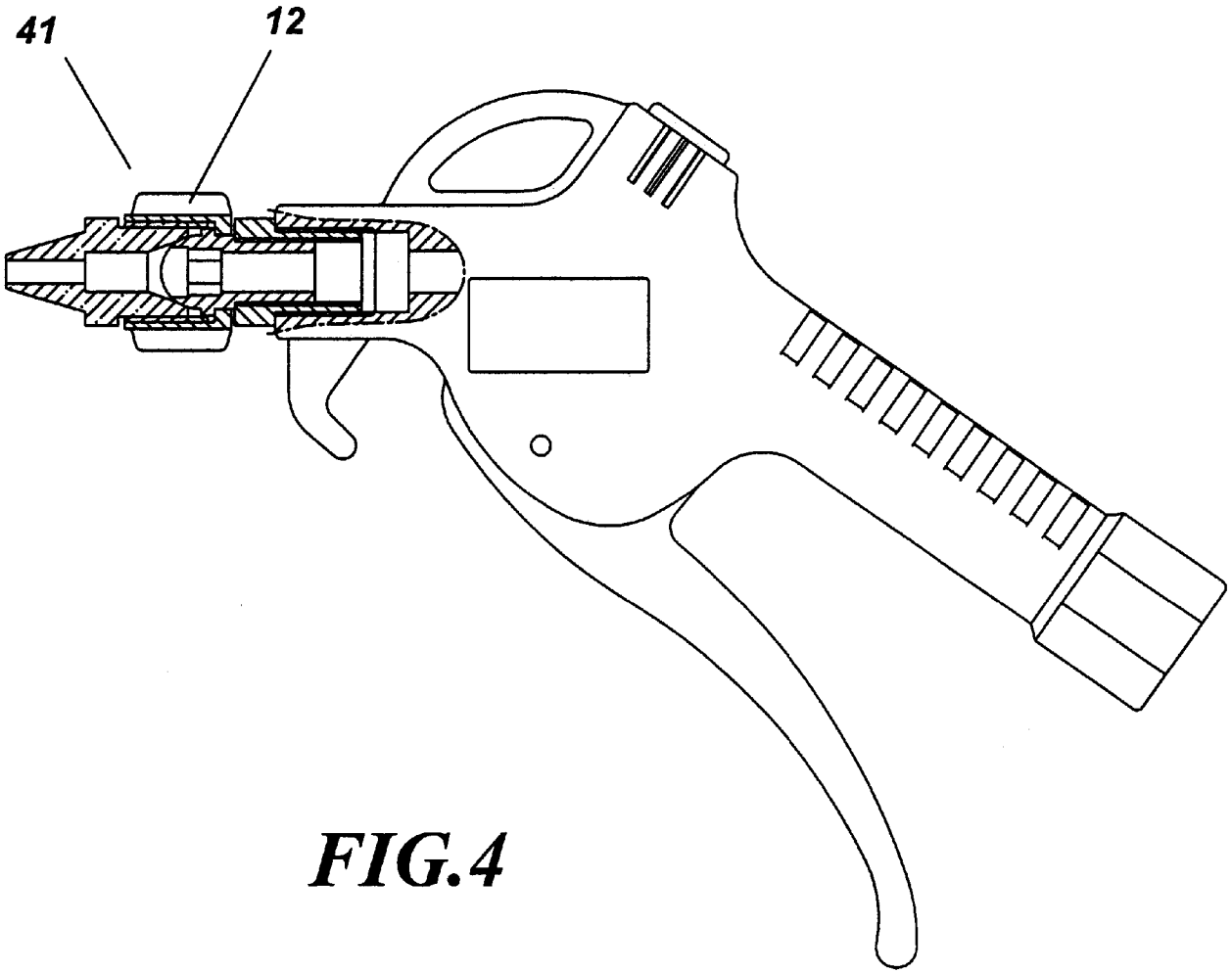
FIG. 4 is a sectional side view showing connecting with an air tool (short blow pistol) in the first embodiment of the present invention.

In accordance with above-description, by taking the advantage of the free rotation and slide state of said shuttle bolt 12, and the ball connection portion 115 of said sleeve bolt 11 extended into the inside of said shuttle bolt 12, quick taking up or apart different pneumatic tool components becomes easy, the detail description is in follows:

The embodiments of connecting to different pneumatic tool component:

By the combined snap securing adaptor 10 attached on the tip end of said gun body 20, different pneumatic tool components can be replaced rapidly, as shown in FIG. 3, a pneumatic tool component 30 (a short blow pistol) has an external screw end 31 that can be secured into the inside of said shuttle bolt 12 to connect to the ball connection portion 115 of said sleeve bolt 11 in bell joint by a bell socket 32 built on the inside at the back end, for sealing the contacting portion between of them tightly, said bell socket 32 has a tapered edge along the rim; by means of the free setting state of said combined snap securing adaptor 10, said pneumatic tool component 30 (a short blow pistol) can be fastened in place rapidly by the user turning the shuttle bolt 12, as shown in FIG. 4, to combine a short blow air gun with the combined short blow pistol 41; as disassembling the pneumatic tool component 30, turning the shuttle bolt 12 in contra-rotation is the only thing to be done, so the operation is easy and rapid.

Figure 5:
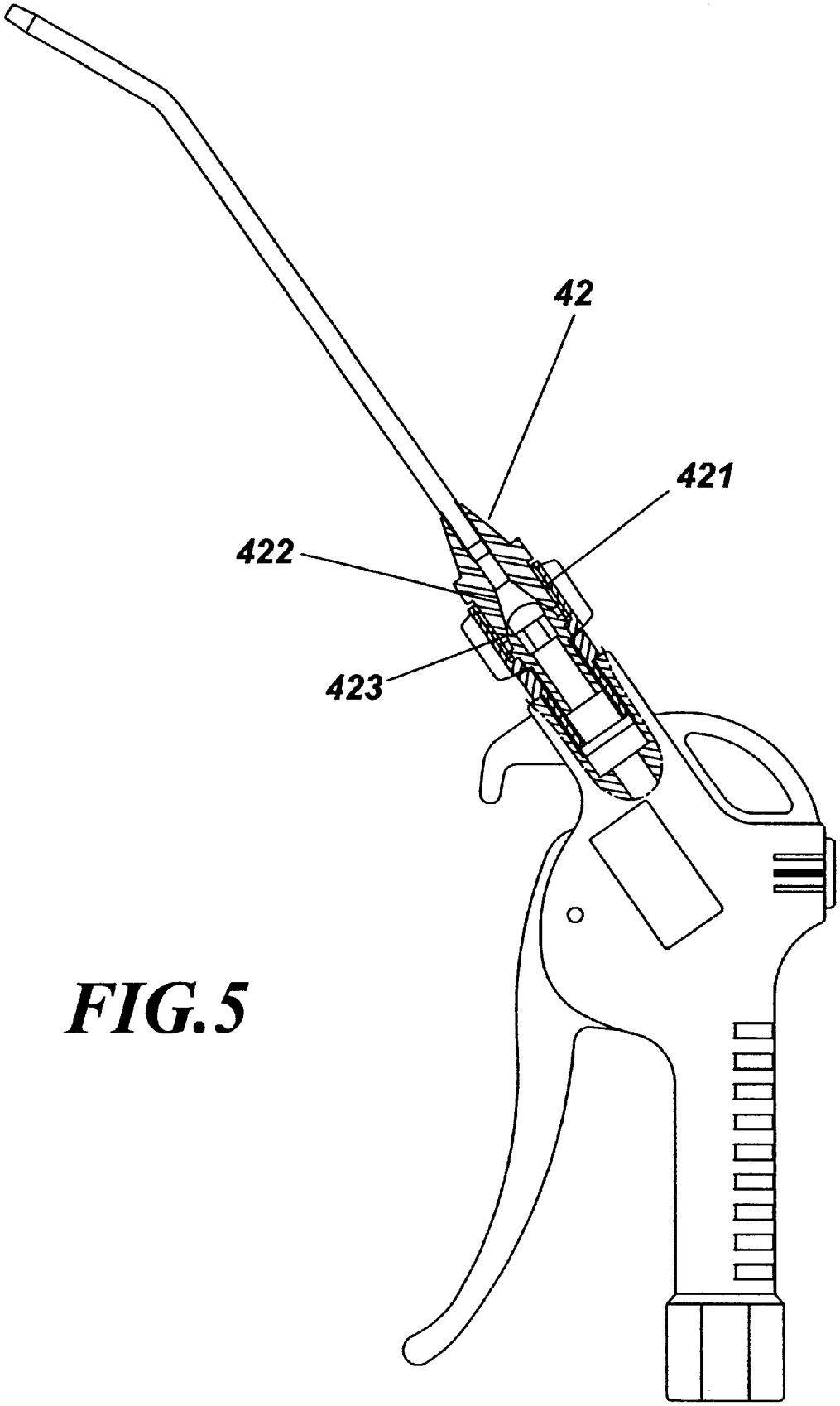
FIG. 5 is a scheme showing the use state in long distance blowpipe method of the present invention.

According to this, different pneumatic tool components just have a standard external thread, a bell socket and a tapered edge on said bell socket so that they can be fastened or dismantled on rapidly by turning said combined snap-securing adaptor 10 in forward or backward. Referring to FIG. 5, a long-distance blowpipe 42 having an external thread 421, a bell socket 422 with a tapered edge 423 can be combined to said gun body 20 to form a long blow air gun for using.

Figure 6:
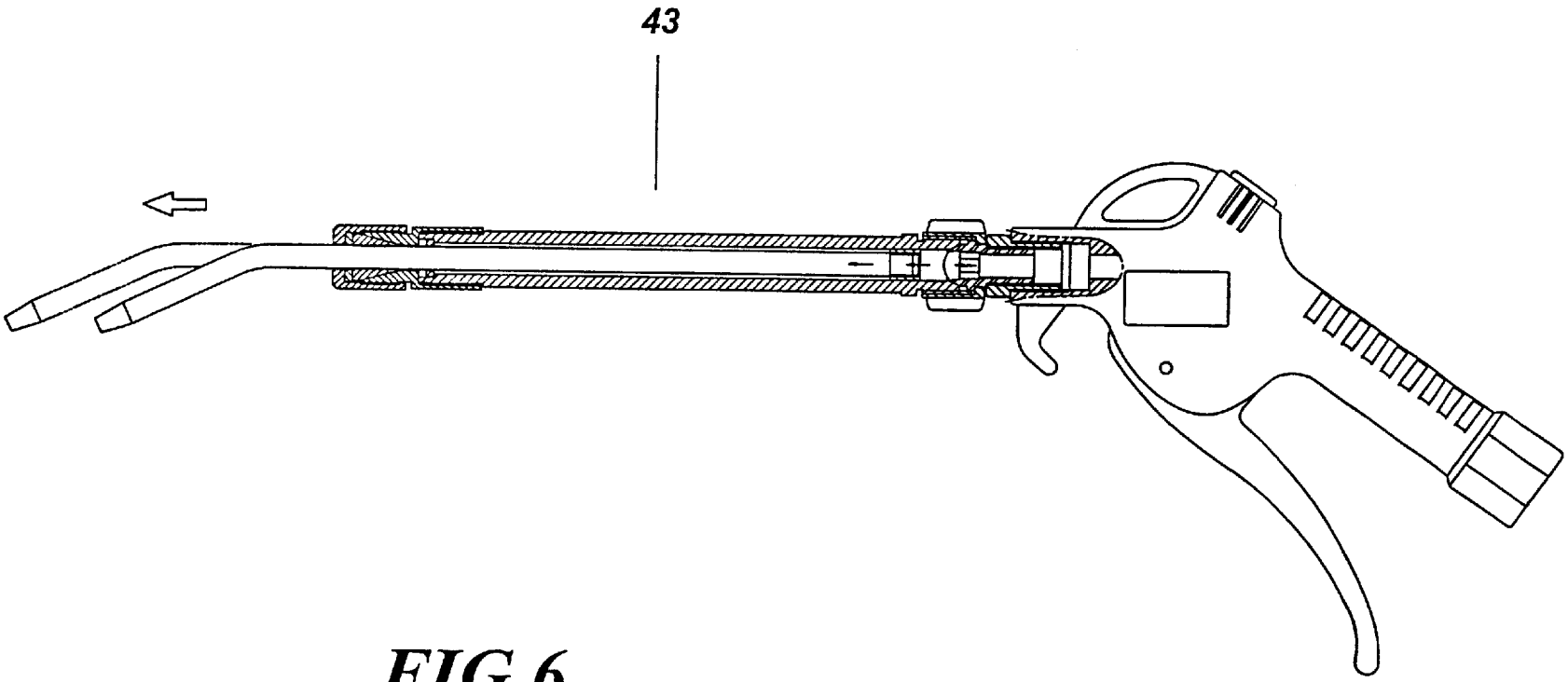
FIG. 6 is a scheme showing the use state in telescope blowpipe method of the present invention.

Or securing a telescope blowpipe 43, as shown in FIG. 6, combines a telescope blow air gun.

Figure 7:
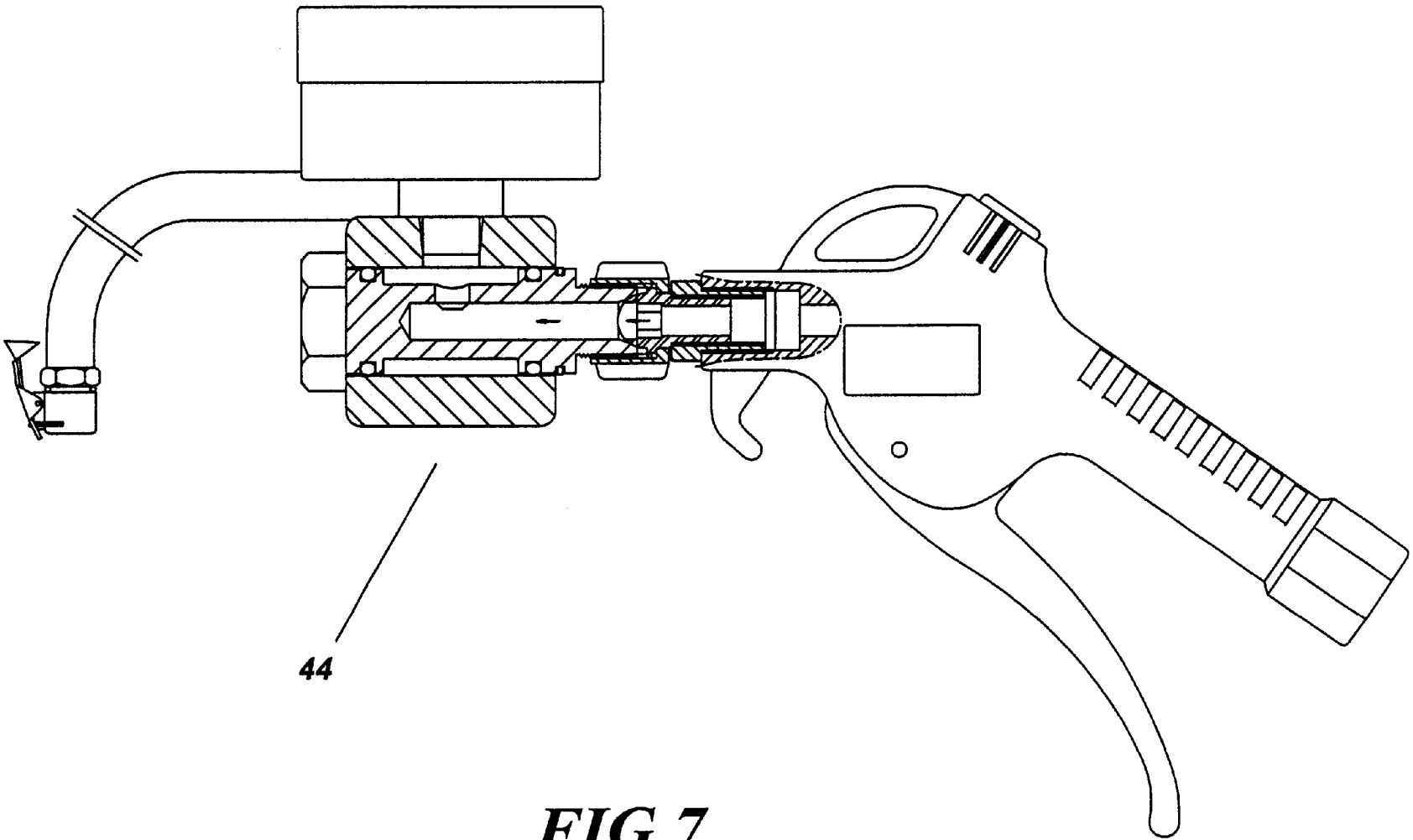
FIG. 7 is a scheme showing the use state in inflating component method of the present invention.

Or as shown in FIG. 7, combining an inflating head 44 forms an inflating air gun to inflate tires.

Figure 8:
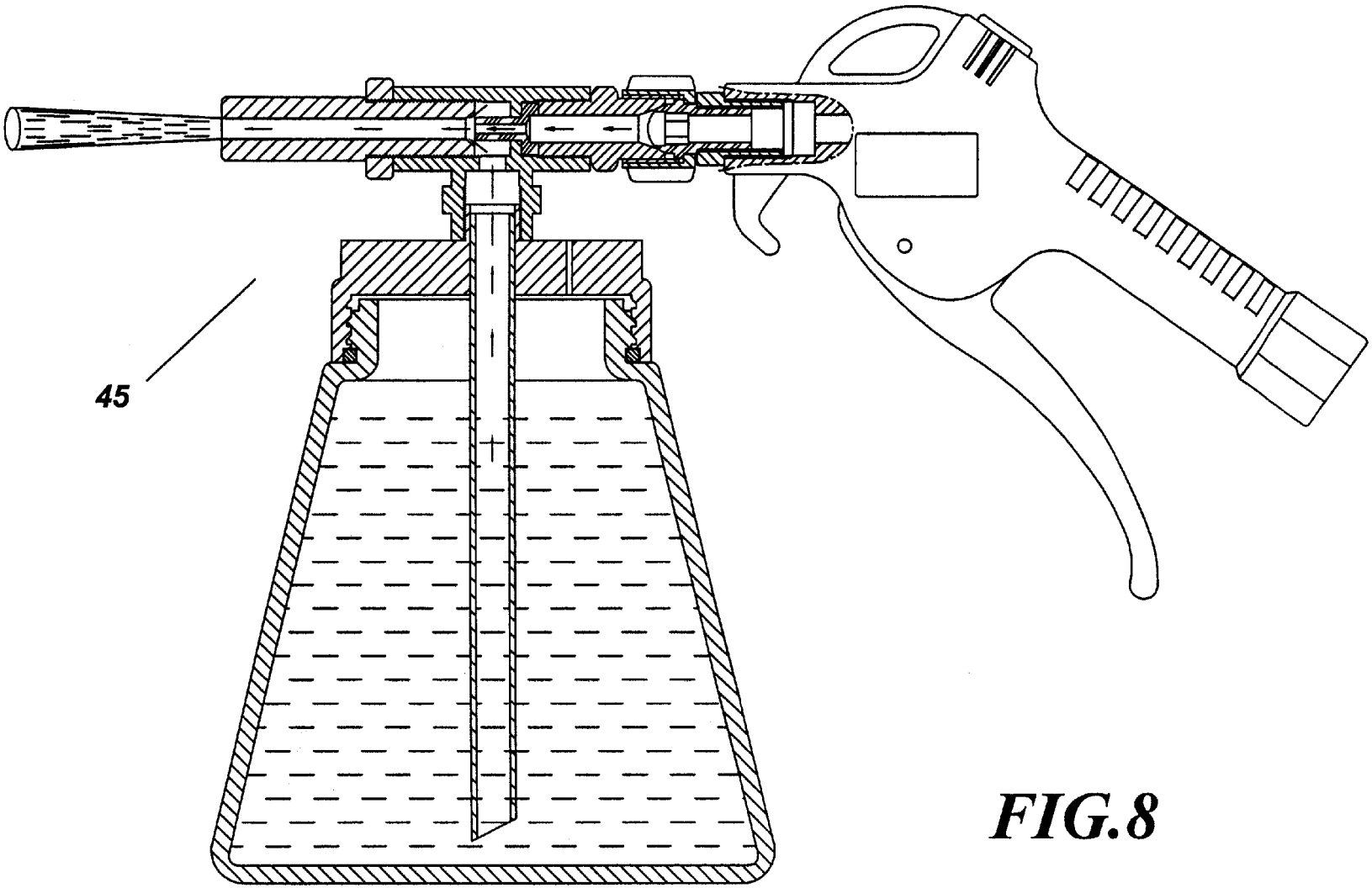
FIG. 8 is a scheme showing the use state of tin method for washing of the present invention.

Or as shown in FIG. 8, a washing head 45 is combined to form a siphon spray washing gun by siphoning scavenger from a container and mixing with compressed air to spray out at high speed to clean the desired place in efficient.

Figure 9:
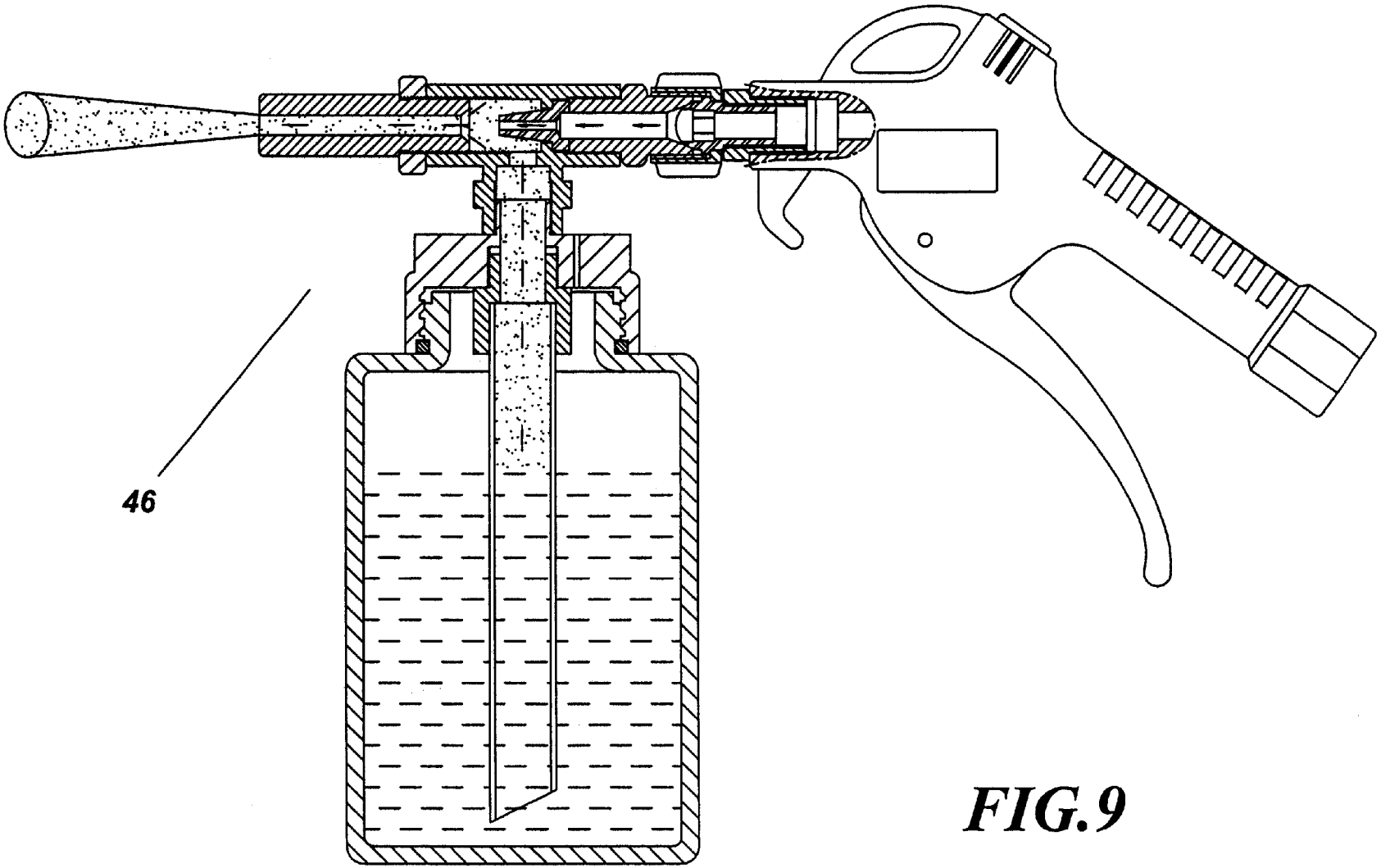
FIG. 9 is a scheme showing the use state of bottle method for spraying glue coat of the present invention.

Or as shown in FIG. 9, attaching a spray glue head 46 combines a spray glue gun by sucking glue from the container with the airless generated by the high speed flow of the compressed air and mixing with compressed air to be sprayed on the surface of working piece to create a glue coat for binding process.

Figure 10:
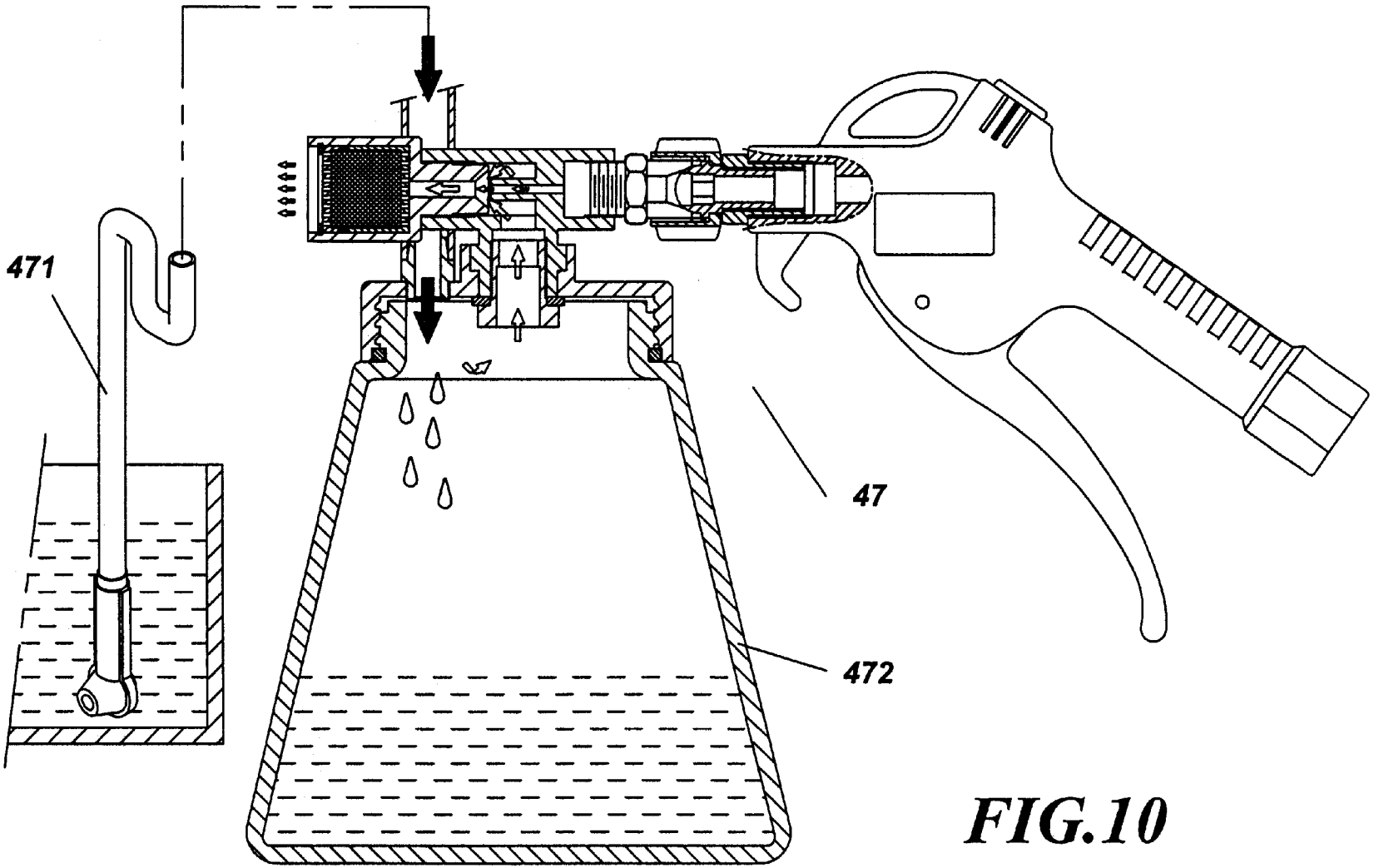
FIG. 10 is a scheme showing the use state of suction method for suctioning oil as an oil head of the present invention.

Or as shown in FIG. 10, combining a suction head 47 forms a suction oil air gun, by stretching the suction pipe 471 into an oil tank, or an engine gear box, or a gear box of other machine, or hydraulic fluid box and so on, under the airless pressure created in said suction pipe 471 by the high speed compressed air, the oil is sucked out from the gear box to transfer into a oil container 472, meanwhile the lighter air is brought out by compressed air from the oil to carry out separating air from oil.

Figure 11:
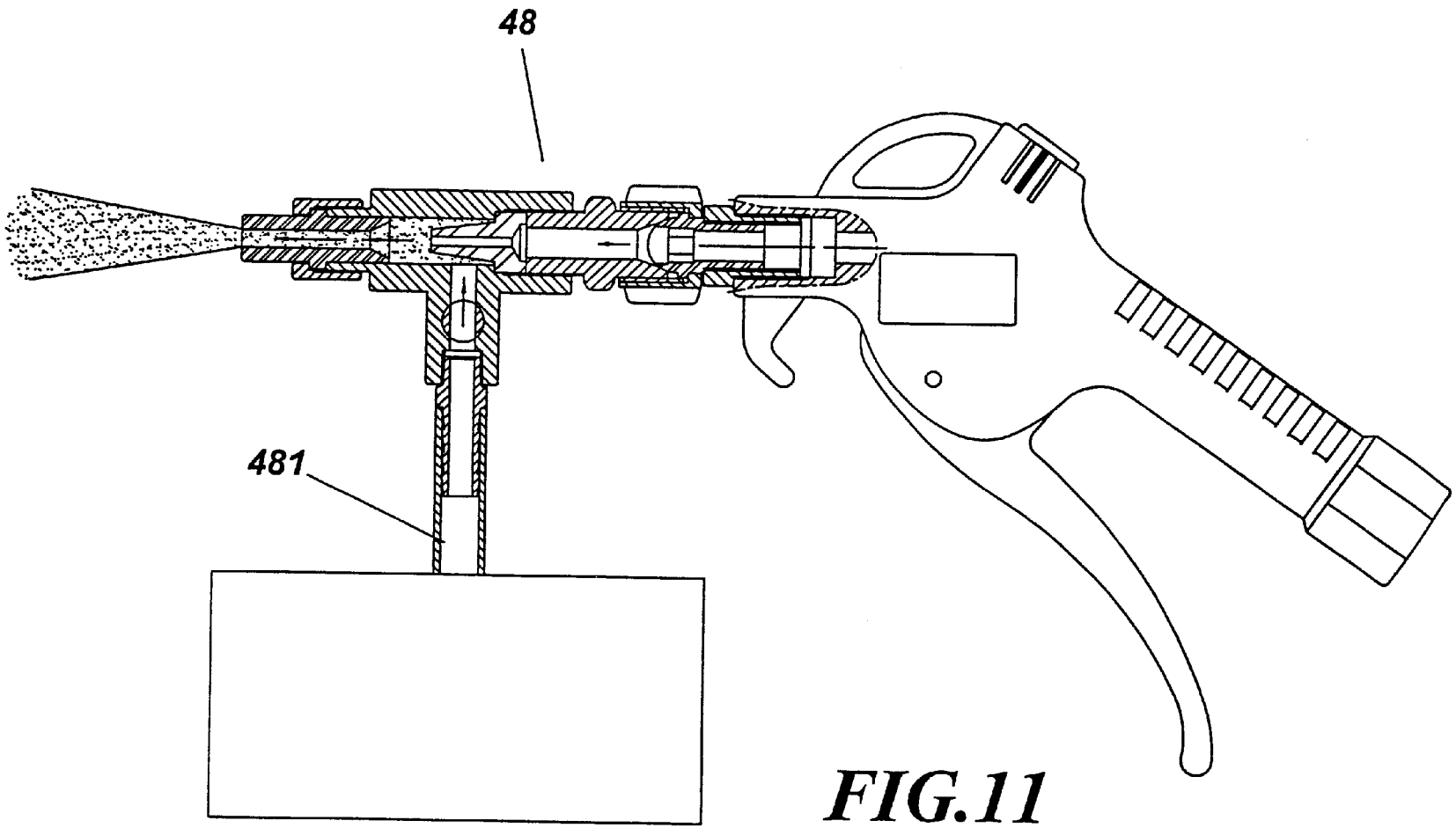
FIG. 11 is a scheme showing the use state of sandblasting method of the present invention.
Figure 12:
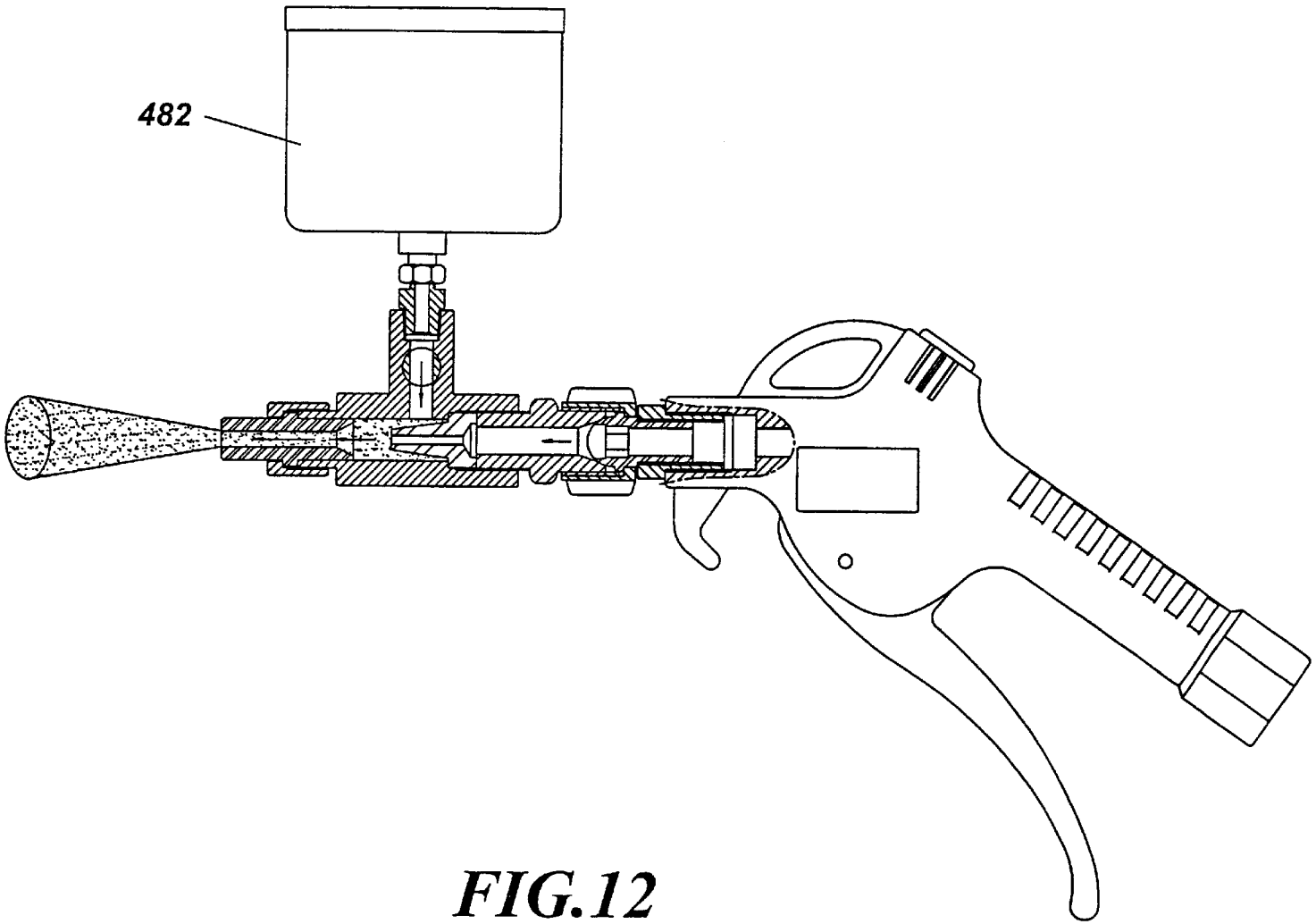
FIG. 12 is a scheme showing the use state of gravity sand blasting method of the present invention.

Referring to FIG. 11, a sand blast head 48 is combined to form a pneumatic sand-blast gun by sucking sand via a suction pipe 481 and being sprayed out following compressed air to perform sand-blasting process; or taking a sand container 482 set on the top side in upward down instead of said suction pipe 481 to form a gravity sand-blasting gun (as shown in FIG. 12) so as to ride off the limitations of working site to operate in any place with higher mobility.

Figure 13:
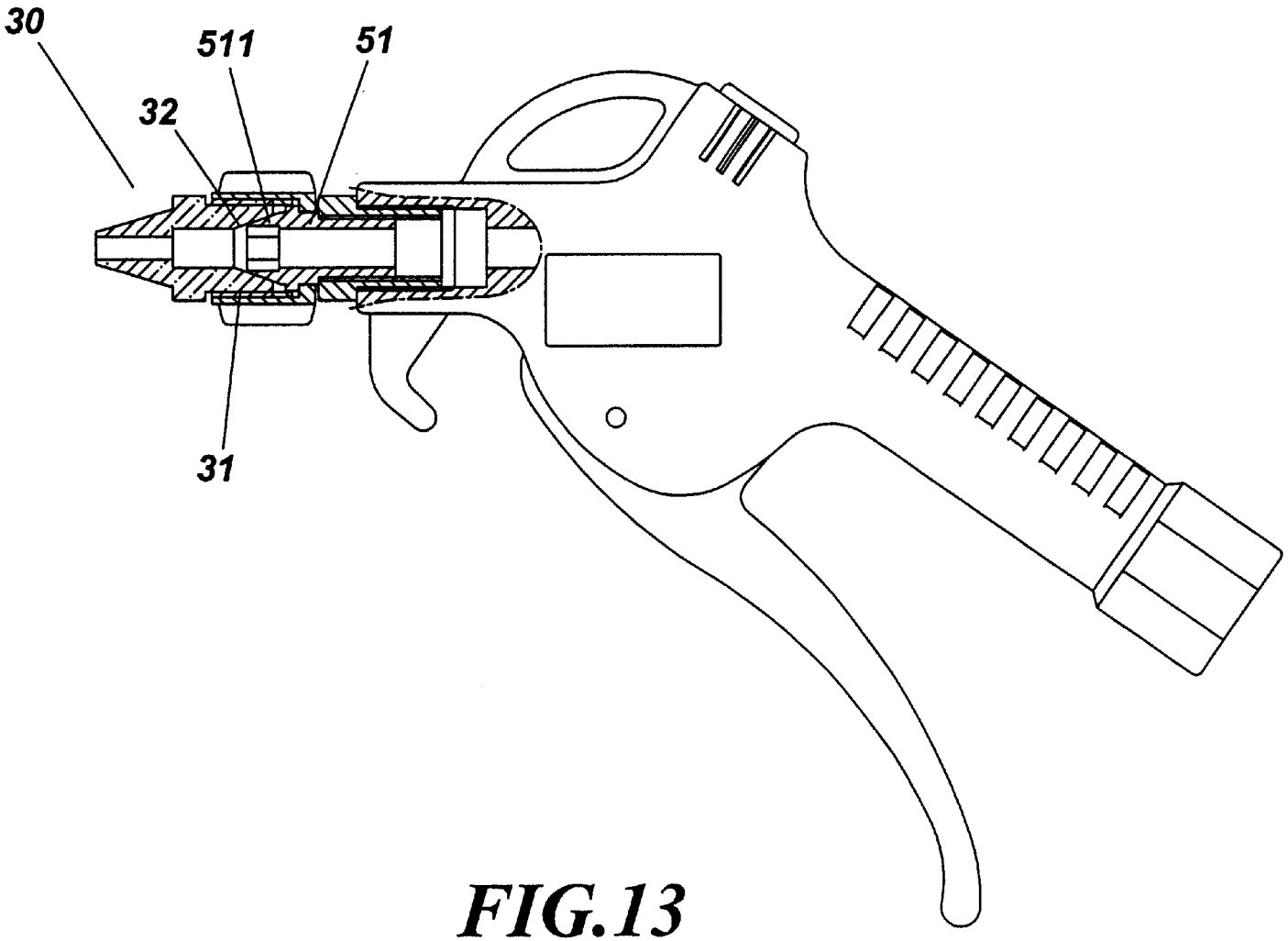
FIG. 13 is a scheme showing the securing connection of the present invention.

In reference with FIG. 13, said connection portion 511 of said sleeve bolt 51 is taken the taper cone shape coordinating to the bell socket 32 on terminal end of the external thread end of said pneumatic tool component 30 in the same taper for getting the better sealing efficiency.

Figure 14:
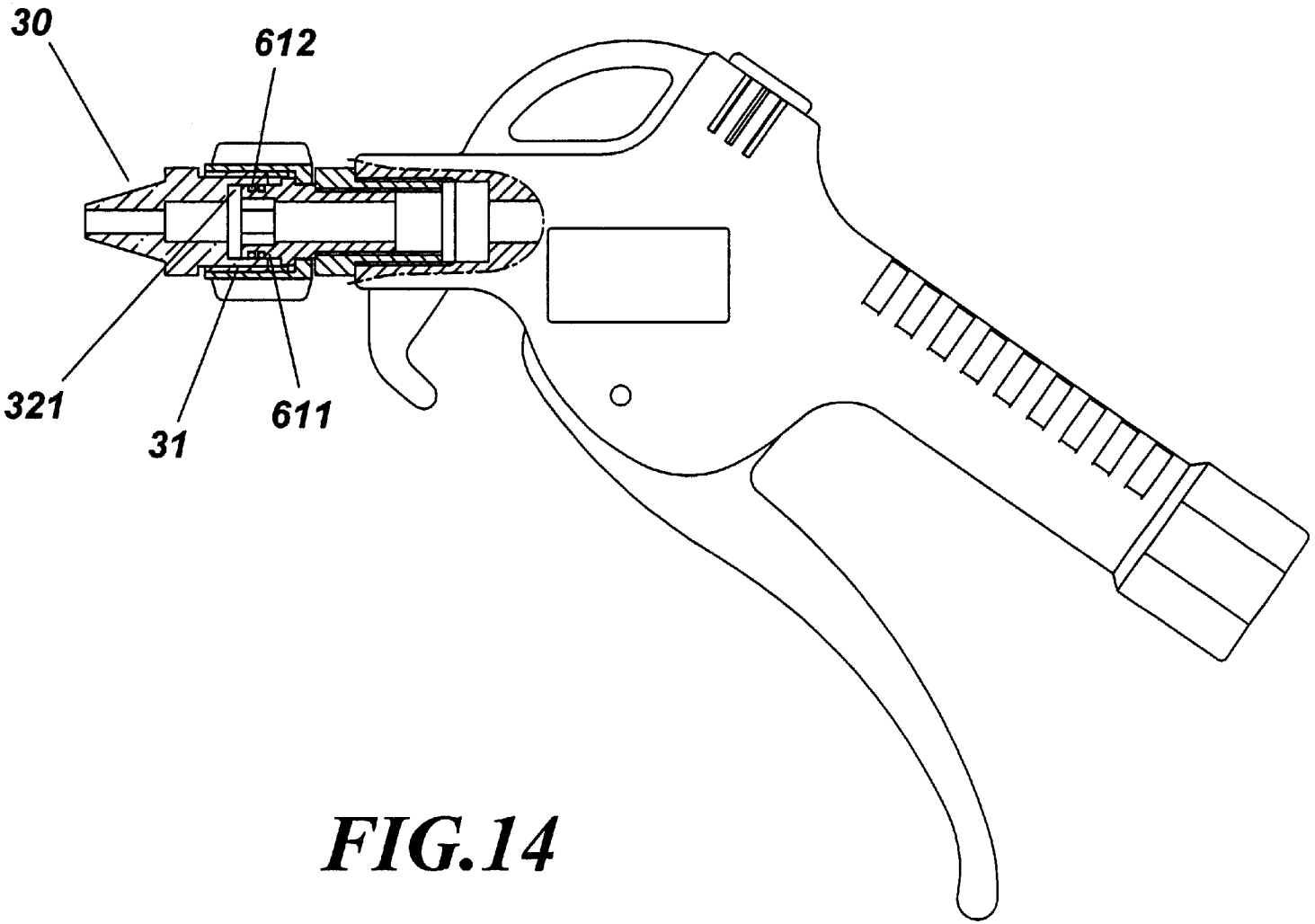
FIG. 14 is a scheme showing the securing connection in the other embodiment of the present invention.
Figure 15:
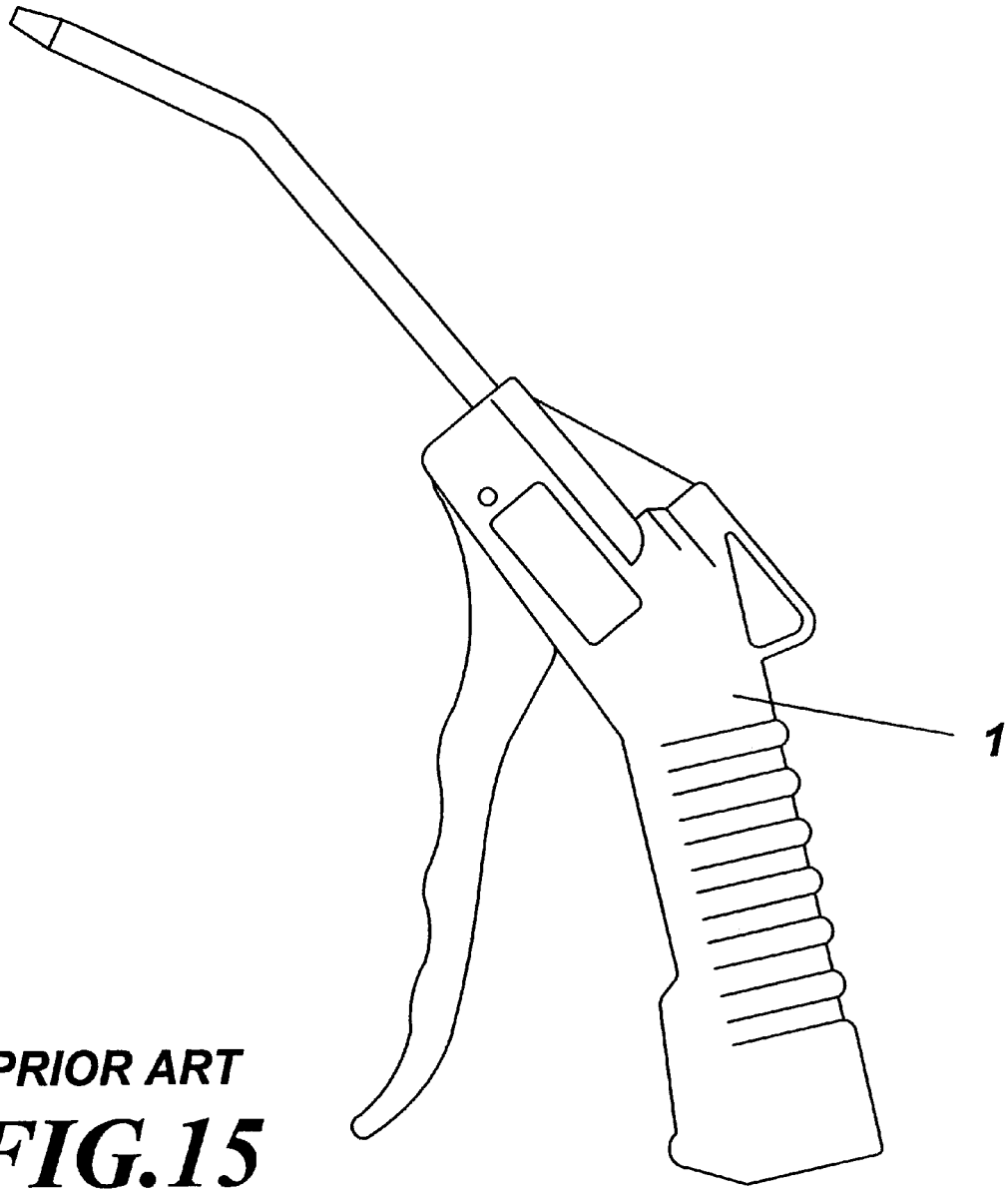
PRIOR ART FIG.15
FIG. 15 is a scheme showing a blowing gun of the prior art.
Figure 16:
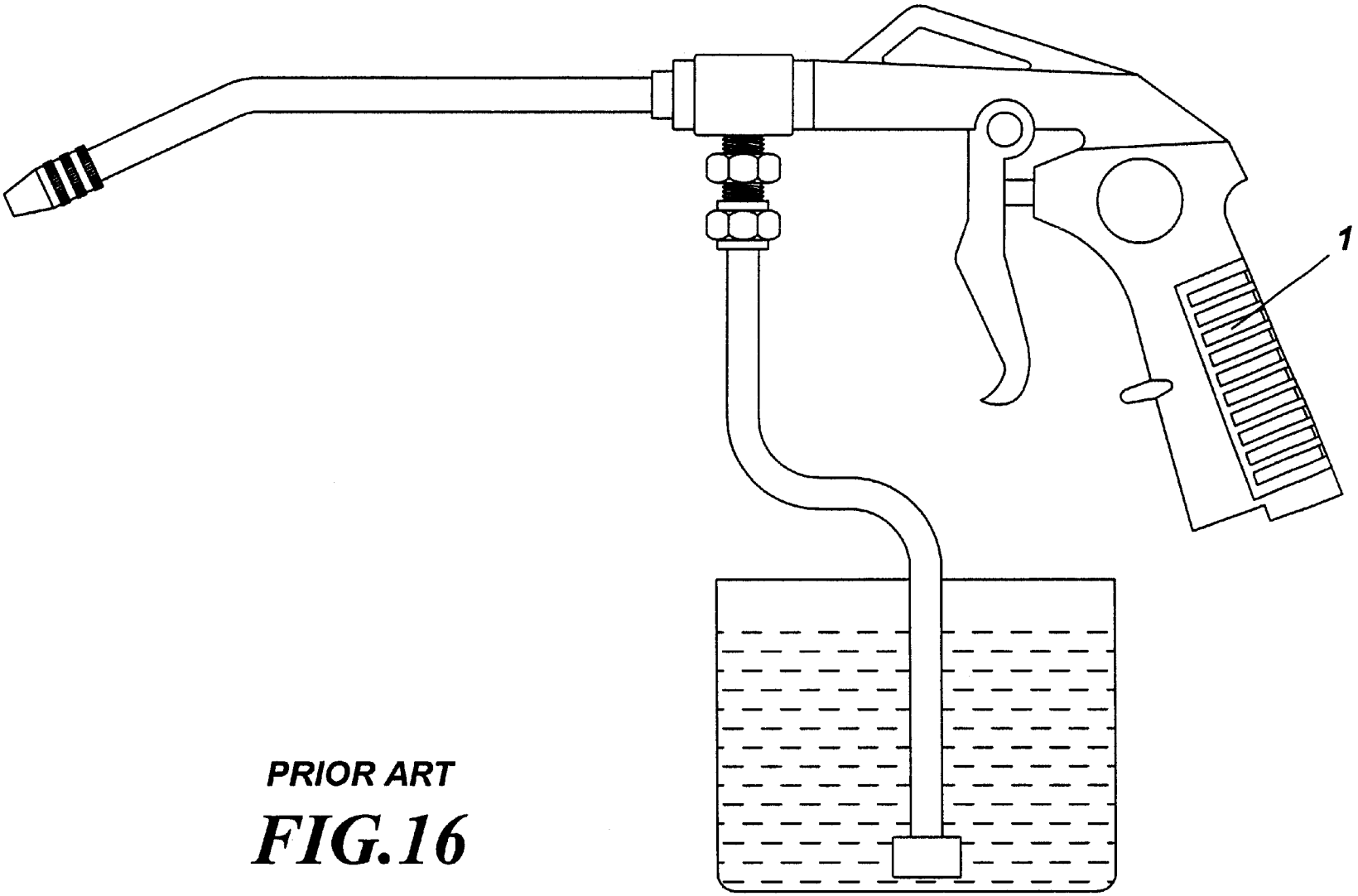
PRIOR ART FIG. 16
FIG. 16 is a scheme showing a cleaning air gun of the prior art.

Additionally, referring to FIG. 14, said connection portion 611 is appeared into straight rod shape, and attached with a seal O-ring at outside surface, coordinating to it said pneumatic tool component 30 has a straight hole 321 built on the external thread 31 end, within the diameter of said straight hole 321 is a bit bigger than said rod connection portion 611's, so that said O-ring 612 can seal between of them as assembling.

I claim:

1. A multipurpose unit air gun-tool comprised of a snap securing combined adaptor, in which one end is secured to a gun body, controlling compressed air to cut in or out, through a retaining bolt with an inside through hole at the outlet of said gun body for securing said combined snap adaptor; wherein said combined snap adaptor includes a sleeve bolt having a through-hole, and a flange having a pivoting connection portion at one side for connecting to a shuttle nut in pivoting connection, on the other side of said flange there is a ball connection portion, and a socket is built on the end of said ball connection portion at approaching the terminal end of said through-hole for securing on with a socket screw wrench gearing in it, and a guide hole a little bit bigger than said socket is built upon the outside of said socket at the terminal end of said through-hole; said sleeve bolt holding said shuttle nut freely is secured on said retaining bolt with a threaded end; said shuttle nut has at least one pair of ribs built on the outside surface axially for grasping to turn rapidly, a pivoting hole built upon one end for putting on the pivoting connection portion of said sleeve bolt in pivoting connection state, and an internal threaded hole built upon the other end of said shuttle nut for securing on different function throttle component.

2. A multipurpose unit air gun-tool as claimed in claim 1, wherein when said sleeve bolt is secured on said retaining bolt with said threaded end, a gap space between the opposite terminal surfaces of said pivoting connection portion and said retaining bolt is left a bit more than the length of said pivoting holes so that the shuttle nut can be moved a bit freely.

3. A multipurpose unit air gun-tool a claimed in claim 1, wherein by touching against between the shoulder of said pivoting hole at the end of said internal threaded hole with said flange of said sleeve bolt, said shuttle bolt is limited in the front end for sliding.

4. A multipurpose unit air gun-tool as claimed in claim 1, wherein said connection portion of said sleeve bolt is taken the taper cone shape coordinating to the bell socket on terminal end of the external thread end of said component in the same taper for getting the better sealing efficiency.

5. A multipurpose unit air gun-tool as claimed in claim 1, wherein said connection portion is appeared into straight rod shape, and attached with a seal ring at outside surface, coordinating to it said component has a straight hole built on the external thread end, so that said ring can seal between them during assembling.

* * * * *